United States Patent [19]

Dejager

[11] 4,452,164

[45] Jun. 5, 1984

[54] SAIL-ATTACHING DEVICE

[76] Inventor: William L. Dejager, 43094 Via Moraga, Fremont, Calif. 94539

[21] Appl. No.: 427,938

[22] Filed: Sep. 29, 1982

Related U.S. Application Data

[63] Continuation of Ser. No. 174,346, Jul. 31, 1980, abandoned.

[51] Int. Cl.[3] ..... B63H 9/08

[52] U.S. Cl. ..... 114/112

[58] Field of Search ..... 114/39, 89, 90, 102, 114/108, 111–114, 204

[56] References Cited

U.S. PATENT DOCUMENTS

| | | | |
|---|---|---|---|
| 3,866,558 | 2/1975 | Bergstrom et al. | 114/90 |
| 3,882,810 | 5/1975 | Roeser | 114/112 |
| 4,143,611 | 3/1979 | Hayhurst | 114/90 |

FOREIGN PATENT DOCUMENTS

| | | | |
|---|---|---|---|
| 449356 | 6/1949 | Italy | 114/112 |
| 88918 | 3/1937 | Sweden | 114/112 |
| 1492030 | 11/1977 | United Kingdom | 114/90 |

*Primary Examiner*—Sherman D. Basinger

*Attorney, Agent, or Firm*—Manfred M. Warren; Robert B. Chickering; Glen R. Grunewald

[57] ABSTRACT

A device is disclosed for attaching a sail to the mast of a sailing vessel, which will allow the sail luff to move laterally and forwardly of the stern side of the mast for improved air flow past the mast and sail. The device includes a follower for mounting on a vertical guide of a standard mast and provides in mast-mounted position a substantially horizontal track having a mid-portion at the stern side of the mast. The track is formed for reciprocation of a luff-attaching shackle between its opposite ends. The track opposite ends are positioned forwardly of the mid-portion and laterally of the mast in mast-mounted position.

3 Claims, 3 Drawing Figures

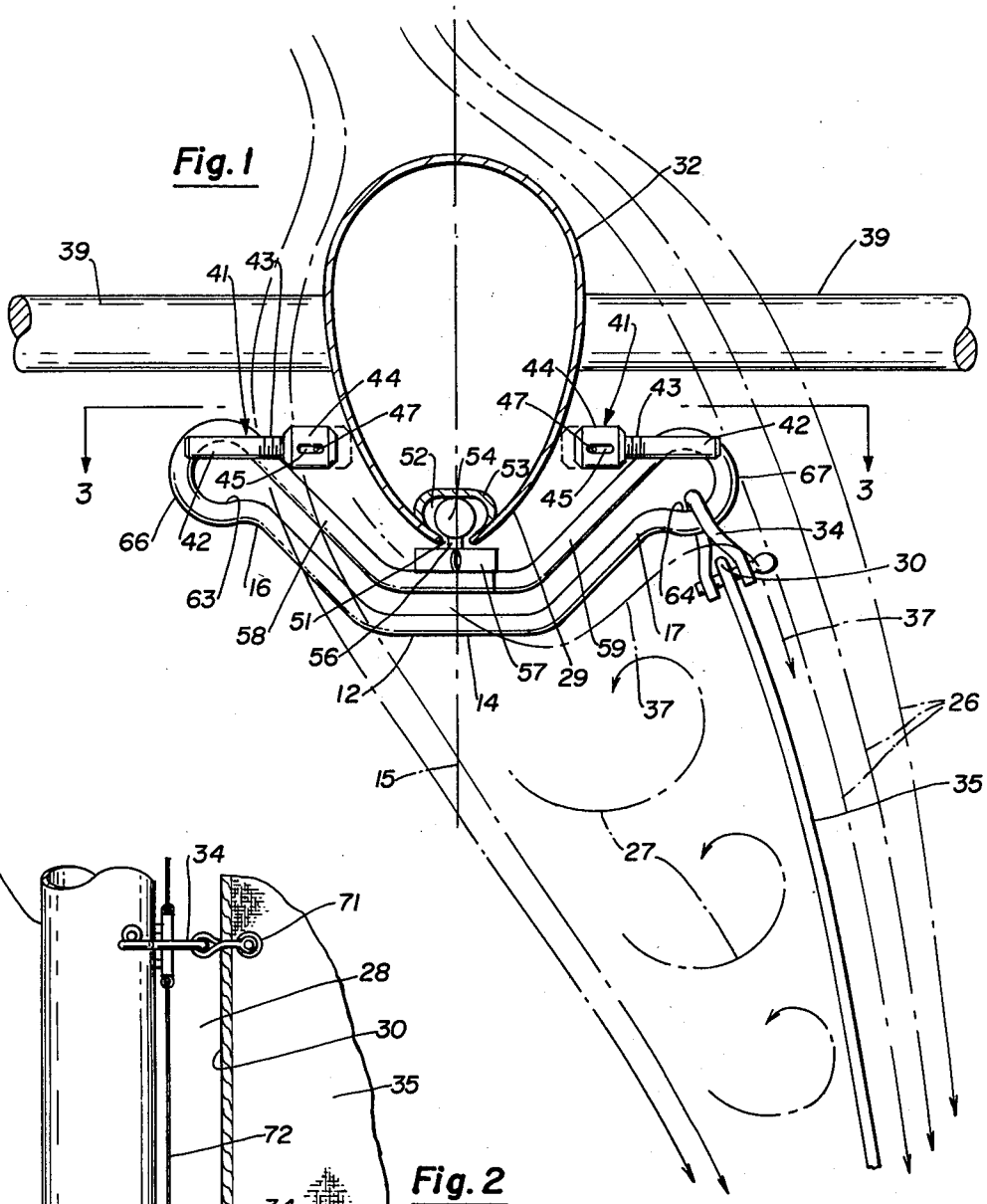
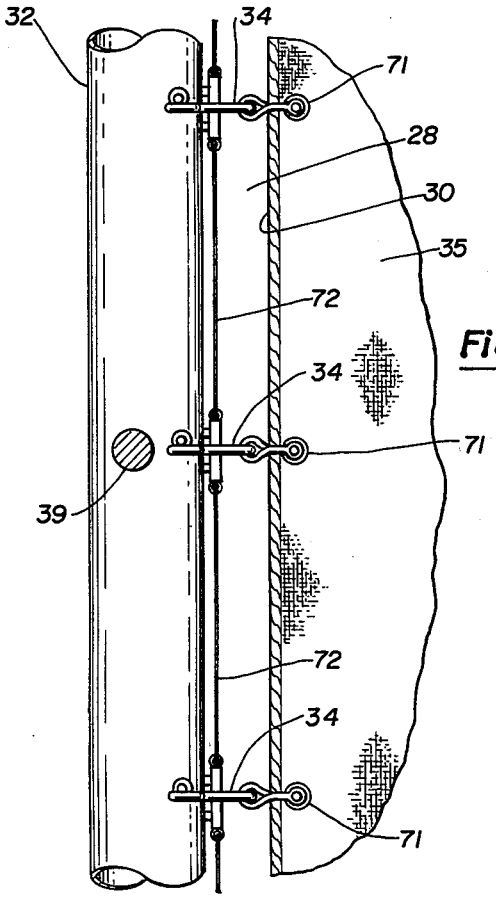
Fig. 2
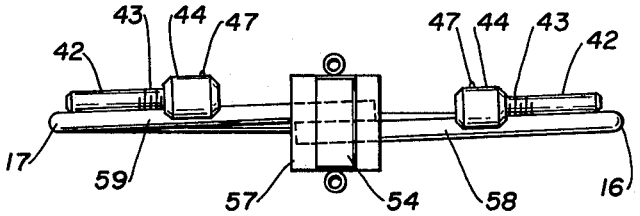
Fig. 3

SAIL-ATTACHING DEVICE

This application is a continuation of application Ser. No. 6/174,346, filed July 31, 1980 now abandoned.

BACKGROUND OF THE INVENTION

The invention relates to means for attaching a fore-and-aft sail to a mast of a sailing vessel.

The driving power which the wind imparts to a sailing vessel depends in great measure on the maintenance of proper airflow past the sails. In the customary method of attaching a fore-and-aft sail to a mast, the sail is supported along a vertical track centered on the stern side of the mast. During the exacting maneuver of beating into the wind, however, the sail-mast interaction deriving from the customary attachment method tends to disrupt the airflow over a forward portion of the sail on its leeward side resulting in a loss of driving power.

Disruptions in airflow can arise from the interaction of a sail with the mast or with other sails or from excessive curvature of the sail itself. Experienced sailors strive to mitigate these disruptions in airflow by assiduously optimizing sail camber and trim while underway in response to changes in wind conditions and heading. Although sail chamber is determined largely by the design of the sail itself, a range of adjustment is provided while underway by exerting variable tension on the sail in appropriate directions, and tackle arrangements for this purpose are well known in the prior art. Such efforts for the most part limit the said area over which the disrupted airflow extends and are not particularly directed toward the source of the disruption itself.

It has been recognized heretofore that some increase in sailing efficiency can be achieved when beating into the wind if the mast and forward portion of the sail are disposed relative to one another to form a comparatively smooth surface of aerodynamically efficient shape, thereby reducing the source of airflow disruption directly. To this end, U.S. Pat. No. 3,882,810 employs a mast of triangular cross section specially adapted at its stern side to allow a sail luff to move laterally thereacross and into alignment with one or the other forwardly facing sides of the mast when the vessel is beating to windward. In this configuration a face of the mast and the forward portion of the sail present a continuous surface to the wind. U.S. Pat. No. 4,143,611 employs sailcloth panels equal in length to the sail luff and secured to either side of the mast. The trailing edges of the panels are connected to the luff in such a manner that the luff can traverse from side to side aft of the mast in response to the wind. In this arrangement the mast, a sailcloth panel, and the forward portion of the sail present a smooth, essentially continuous surface to the wind.

Modifications such as these offer smoother, hence less disruptive surfaces to the wind. They typically do so, however, with an accompanying increase in sail camber and deformation of the overall aerodynamic profile of the sail-mast system, leading to less than full harnessing of the wind. Furhermore, they require modifications, sometimes extensive, of the mast, rigging or vessel itself.

SUMMARY OF THE INVENTION

It is an object of the present invention to provide means for attaching a sail to a mast which will enable the sail to assume an aerodynamically efficient position with respect to the mast and which at the same time will maintain a minimum of sail camber when beating into the wind.

Another object of the invention is to provide a sail-attaching means of the above character which is usable with any of the generally available masts and which can be easily installed by the user with no modification of the mast, rigging or vessel.

A further object of the present invention is to provide a sail-attaching means of the above character which does not appreciably increase windage or weight aloft.

The above objects are met by a device which can be mounted in a standard sail-attachment track on the stern side of a mast and which allows movement of a sail luff laterally of the mast and forwardly of the stern side of the mast in response to the wind. The invention comprises, in summary, a means adapted to be mounted for vertical guided movement on the mast and providing in its mast-mounted position a continuous, substantially horizontal track having a mid-portion at the stern side of the mast opposite ends extending horizontally to opposite sides of the longitudinal center line of the vessel. The means is formed to position the opposite ends of the track forwardly of the mid-portion and laterally of the mast when in mast-mounted position. The track is formed for support of luff-attaching means and for reciprocation of the luff-attaching means between its opposite ends.

The invention possesses other features and objects, some of which will be set forth in the following description of the preferred embodiments. It is to be understood, however, that variations in the showing made by the drawings and description herein may be adopted within the scope of the invention as set forth in the appended claims.

BRIEF DESCRIPTION OF THE DRAWINGS

FIG. 1 is a top view of a sail attaching device constructed in accordance with the present invention shown in sail supporting, mast-mounted position, the mast being shown in cross section.

FIG. 2 is a fragmentary side elevation of the structure shown in FIG. 1.

FIG. 3 is a rear elevation of the device without the associated structure shown in FIG. 1 and as indicated by the plane of line 3—3 of FIG. 1.

DETAILED DESCRIPTION OF THE PREFERRED EMBODIMENTS

The sail-attaching device of the present invention comprises means adapted for mounting for vertical guided movement on mast 32 and providing in mast-mounted position a continuous, substantially horizontal track 12 having a mid-portion 14 at the stern side of the mast and opposite ends 16 and 17 extending horizontally to opposite sides of the longitudinal center line 15 of the vessel, and preferably with ends 16 and 17 projecting forwardly of mid-portion 14. The track 12 is formed for support of luff-attaching means 34, through which sail 35 is connected to the track 12, and for reciprocation of luff-attaching means 34 between the opposite ends 16 and 17 of track 12. As a feature of the present invention, means 41 is connected to track 12 and positioned for engagement with and for free vertical reciprocation upon the port and starboard sides of mast 32 for limiting rotary displacement of the track in a horizontal plane and fore and aft displacement of the ends 16 and 17 under the action of tension exerted by the sail 35. As here shown, such means comprises a pair of members mounted on the track adjacent its opposite ends 16 and 17 and which projects laterally towards the center of the device and are of adjustable length for adapting the device to different size masts. These members each consist of a shank 42 mounted adjacent a track end 16, 17 to project toward the mast, and a mast engaging head 44 mounted on the shank for movement to and from the mast. Conveniently head 44 may be threaded on the internally projecting end 43 of the shank so as to facilitate adjustable positioning of the head relative to the mast, and the head may be secured in adjusted position by a pin 47 mounted through a slot 45 in the head and a registering diametric hole in shank end 43.

A feature of the present invention is the direct adaptability of the present device to existing standard masts for sailing vessels, as such masts are depicted in FIG. 1 of the drawing. This type mast is formed with a longitudinally extending slot 51 at the stern center of the mast, slot 51 opening to an enlarged interior chamber 52 defined by a curved interior wall 53 extending lengthwise of the mast. The mounting means here shown comprises a cylindrical member 54 dimensioned for engagement with and centering within wall 53 with a web or flange 56 projecting laterally through slot 51 and connected to a support plate 57 juxtaposed to mid-portion 14 of the track. Secured to and extending laterally from support plate 57 are a pair of arms 58 and 59 which are connected at their opposite ends to the opposite ends 16 and 17 of track 12 so as to support the latter in free standing relation over its length, i.e., having its supporting structure confined solely to its opposite ends. As here shown, the track and arms may be formed from a single length of rod or tube stock bent as illustrated in FIG. 1 to provide spaced apart track and arm portions with the opposite ends of the rod or tube member positioned in side-by-side relation upon and secured, as by welding, to plate 57.

It has been found advantageous to provide means for preferentially retaining the luff-attaching means in outboard position on the track. This may be conveniently accomplished as here shown by forming the track ends 16 and 17 with laterally offset portions 63 and 64 onto which the luff-attaching means 34 may move and be preferentially retained as the luff moves to either left or righthand outboard position. As here shown, such offset portions may be conveniently formed by loop-like structures 66 and 67 connecting the adjacent outer ends of the arms and track.

The luff-attaching means 34 may here comprise a conventional twisted shackle to encircle track 12 for free sliding movement thereon with the demountable ends of the shackle secured through the conventional luff cringle 71. Movement of the shackles to the rear of the device around the loop portions 66 and 67 is prevented by members 41. Modification of the track structure would permit threading of the track itself through the luff cringle.

As is well known, when beating into the wind the pressure difference across the sail produces an aerodynamic lift force having a component which urges the vessel to heel. With the customary method of attaching the sail to the mast, a region of reduced pressure difference arises immediately aft of the mast owing to the formation of a pocket of turbulance on the leeward side of the sail, which is accompanied by local separation of laminar airflow from the sail. The airflow does not then reattach itself to the sail until it has reached a point farther aft, where the sail is more nearly parallel to the center line of the vessel. The result is a reduction in the driving component and an increase in the heeling component of the aerodynamic lift. By permitting lateral and forward motion of the leading edge 30 of the sail in response to the natural aerodynamic lift force exerted thereon, the present device leads to improved laminar-flow characteristics on the leeward side of the sail and greater utilization of the forward portion of the sail to generate aerodynamic lift. Approximate airflow past a mast and sail coupled by means of the present device is shown in FIG. 1. Streamlines indicating laminar flow are denoted by 26. Spiralling lines indicating turbulent eddies are denoted by 27.

The lateral and forward travel of the sail luff 30 brings the luff into proximity to, but in spaced relation from, the forward portion of the leeward surface 29 of the mast; and the mast surface and the forward portion of the sail taken together outline an aerodynamic profile to which laminar airflow can easily attach. The region of unattached airflow in this configuration is greatly reduced over that in the customary sail-mast configuration. The spacing between the forwardly drawn luff 30 and the leeward surface 29 of the mast defines an air slot 28 providing the flow of a minor but significant portion of the high pressure air from the windward to the leeward side of the sail where it contributes to laminar flow, as indicated by arrows 37 in FIG. 1. The horizontal disposed length of track 12 projects the opposite ends 16 and 17 of the track beyond the port and starboard sides of the mast by a distance ranging from about one-quarter of to about the athwart ship dimension of the mast. The slot must be small for its action to have a beneficial effect, for otherwise a region of turbulence would tend to spread along the lee surface causing the laminar flow to separate from the sail. The forwardly extending course of the track serves to reduce the size of the slot.

The forward course of the track also helps to maintain a flat sail when beating into the wind. A luff which can travel laterally, but not forwardly of the mast will increase the camber of the sail when beating into the wind. As the luff travels along a course perpendicular to the center line 15, the straight-line distance from the laterally displaced luff to the leech (i.e., a chord of the sail profile) diminishes, although the length of sail between luff and leech at any height is fixed. The result is a baggier sail, which is undesirable when beating into the wind. The forward extension of the track provides the additional chord length to maintain a flat sail.

The tension in the sail will, of course, exert a rearward pull on the track, tending to cause the track ends to rotate about the point of support on the mast. Such a rotation and the associated fore and aft motion of the track ends changes the position of the luff, thereby increasing sail camber as discussed above, and puts undesirable stress on the means used to mount the track on the mast. The anti-rotary means 41 described above serves to counter-balance the rearward pull on the track exerted by the sail.

Due to the delicate balance of large forces being exerted on the luff, there is a tendency for the luff-attaching shackle 34 to creep aft along the track. To resist this tendency the preferential retaining means or traps 63 and 64 have been included at the ends of the track to hold the luff in its outboard position.

When raising and lowering the sail, the present sail-attaching device operates much in the same manner as a conventional sail-attaching slide. The sail will have a plurality of cringles or grommets 71 along its luff. Each cringle 71 is connected to one of the devices of the present invention as above explained. The slide members 54 are inserted in the vertical guide on the mast as is any conventional sail slide. To prevent misalignment of the cringles and ease raising and lowering of the sail, it has been found advantageous to secure the several sail-attaching devices to each other in a continuous string by means of lines 72 connected between the support plates 57, see FIG. 2. It has also been found that the opposite ends of track 12 can be angled sufficiently far forward to achieve the beneficial effects of reduced sail camber and enhanced slot action without interfering with the spreaders 39. Thus, a sail can be installed easily with no need for tools or special training and without modification of the mast or associated rigging. Furthermore, the sail can be raised, lowered, reefed, stowed or removed as easily as a conventionally attached sail. Finally, it will be observed that due to the insubstantial increase in the surface area presented and lightweight construction of the individual devices especially when the track 12 is formed of hollow tubing, the present device allows all the advantages of a lateraliy and forwardly displaceable sail without substantially increased windage or weight aloft.

What is claimed is:

1. Sail luff to mast mounting means for a sailing vessel comprising:

a plurality of devices adapted for mounting for independent vertical guided movement on said mast and providing in mast-mounted position a plurality of vertically superimposed continuous and substantially horizontally disposed tracks each having:

(a) a mid-portion confined at the stern side of said mast for vertical reciprocation on substantially the fore and aft center plane of said mast, (b) a horizontally disposed length providing opposite ends of said track projecting simultaneously beyond the port and starboard sides of said mast by a distance ranging from about one-quarter of the full athwart ship dimension of said mast to about the full athwart ship dimension of said mast, (c) said tracks being formed for support of and for reciprocation thereon between said opposite ends of luff-attaching means, said devices being adapted for connection at substantially equal intervals for hoisting said devices and sail luff on said mast, and means connected to each of said tracks and formed to engage with and to vertically reciprocate upon said mast for limiting rotary displacement of said tracks in a horizontal plane and fore and aft displacement of said ends.

2. The apparatus of claim 1, said last-named means comprising an extendable mast-engaging member permitting adjustable positioning of said member with respect to its associated track and said mast.

3. The apparatus of claim 2, said mast-engaging member comprising a part fixed to each of said tracks and in mast-mounted position projecting toward said mast;

a head mounted on said part for movement to and from said mast; and means locking said head on said part.

* * * * *